US011131943B1

(12) United States Patent
Tanaka et al.

(10) Patent No.: US 11,131,943 B1
(45) Date of Patent: Sep. 28, 2021

(54) IMAGE FORMING APPARATUS

(71) Applicant: KYOCERA Document Solutions Inc., Osaka (JP)

(72) Inventors: Kazunori Tanaka, Osaka (JP); Yoshihiro Yamagishi, Osaka (JP); Tamotsu Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/210,395

(22) Filed: Mar. 23, 2021

(30) Foreign Application Priority Data

Mar. 25, 2020 (JP) ..... JP2020-054341

(51) Int. Cl.
*G03G 15/06* (2006.01)

(52) U.S. Cl.
CPC ..... *G03G 15/065* (2013.01)

(58) Field of Classification Search
CPC ..... G03G 15/047; G03G 15/065; G03G 15/0856; G03G 15/0907
USPC ..... 399/38, 53, 55, 56
See application file for complete search history.

(56) References Cited

U.S. PATENT DOCUMENTS 7,979,011 B2 * 7/2011 Fujihara ..... G03G 15/065 399/270
10,775,727 B2 * 9/2020 Yamaguchi ..... G03G 15/5041
2020/0272069 A1 * 8/2020 Kobayashi ..... G03G 15/0225

FOREIGN PATENT DOCUMENTS

JP 2003-295540 A 10/2003

* cited by examiner

*Primary Examiner* — Hoan H Tran
(74) *Attorney, Agent, or Firm* — Studebaker & Brackett PC

(57) ABSTRACT

An image forming apparatus includes: a development device that develops an electrostatic latent image formed on a photosensitive drum into a toner image; a charger that charges the photosensitive drum; a development power supply that applies a prescribed bias voltage to the development device; an electric current measuring section that measures a development current flowing in the development device; and a calculating section that calculates a surface potential of the photosensitive drum based on the development current. The development device sequentially forms a plurality of image formation toner images on respective sheets of a recording medium. The image formation toner images each are a toner image for image formation. The electric current measuring section measures the development current in a period during which the image formation toner images are not formed.

4 Claims, 10 Drawing Sheets

| | Bias voltage [V] | Development current [μA] |
|---|---|---|
| Reference 1 | 240 | −0.15 |
| Reference 2 | 300 | 0.12 |

IMAGE FORMING APPARATUS

INCORPORATION BY REFERENCE

The present application claims priority under 35 U.S.C. § 119 to Japanese Patent Application No. 2020-054341, filed on Mar. 25, 2020. The contents of this application are incorporated herein by reference in their entirety.

BACKGROUND

The present disclosure relates to an image forming apparatus.

In electrographic image forming apparatuses such as copiers or printers, an image formation process is widely used in which toner is attached to an electrostatic latent image formed by irradiating the uniformly charged surface of a photosensitive drum (image bearing member) with light to develop the electrostatic latent image into a toner image. To obtain a high-quality image, it is necessary to perform development using a development bias with an adequate potential difference from the surface potential of the photosensitive drum.

To that end, it is necessary to detect the actual surface potential of the photosensitive drum when forming an image, and the surface potential of the photosensitive drum has conventionally been detected using a surface potential sensor.

However, a surface potential sensor is problematic in that it is high in cost and cannot perform accurate measurement once scattered toner or the like attaches to the photosensitive drum. In view of the foregoing, a technique of obtaining the surface potential of a photosensitive drum without using a high-cost sensor such as a surface potential sensor is offered.

For example, an electrophotographic apparatus obtains the surface potential of a photosensitive member by forming a pulse-shaped electrostatic potential pattern on the photosensitive member, applying a bias to a development roller, and measuring the electric current flowing into the development roller from the photosensitive member when the electrostatic potential pattern is developed. Specifically, the surface potential of the photosensitive member is estimated by monitoring the electric current in the alternating points of the pulse-shaped electrostatic potential pattern. In this manner, the surface potential of the photosensitive member can be obtained without using a surface potential sensor.

SUMMARY

An image forming apparatus according to an aspect of the present disclosure includes an image bearing member, a charger, a development device, a development power supply, an electric current measurement section, and a calculating section. The image bearing member has a surface on which an electrostatic latent image is formed. The charger charges the image bearing member. The development device develops the electrostatic latent image formed on the image bearing member into a toner image by supplying a toner to the image bearing member. The development power supply applies a prescribed bias voltage to the development device. The electric current measuring section measures a development current flowing in the development device. The calculation section calculates a surface potential of the image bearing member based on the development current measured by the electric current measurement section. The development device sequentially forms a plurality of image formation toner images on respective sheets of a recording medium. The image formation toner images each are a toner image for image formation. The electric current measuring section measures the development current in a period during which the image formation toner images are not formed.

DETAILED DESCRIPTION

Figure 1:
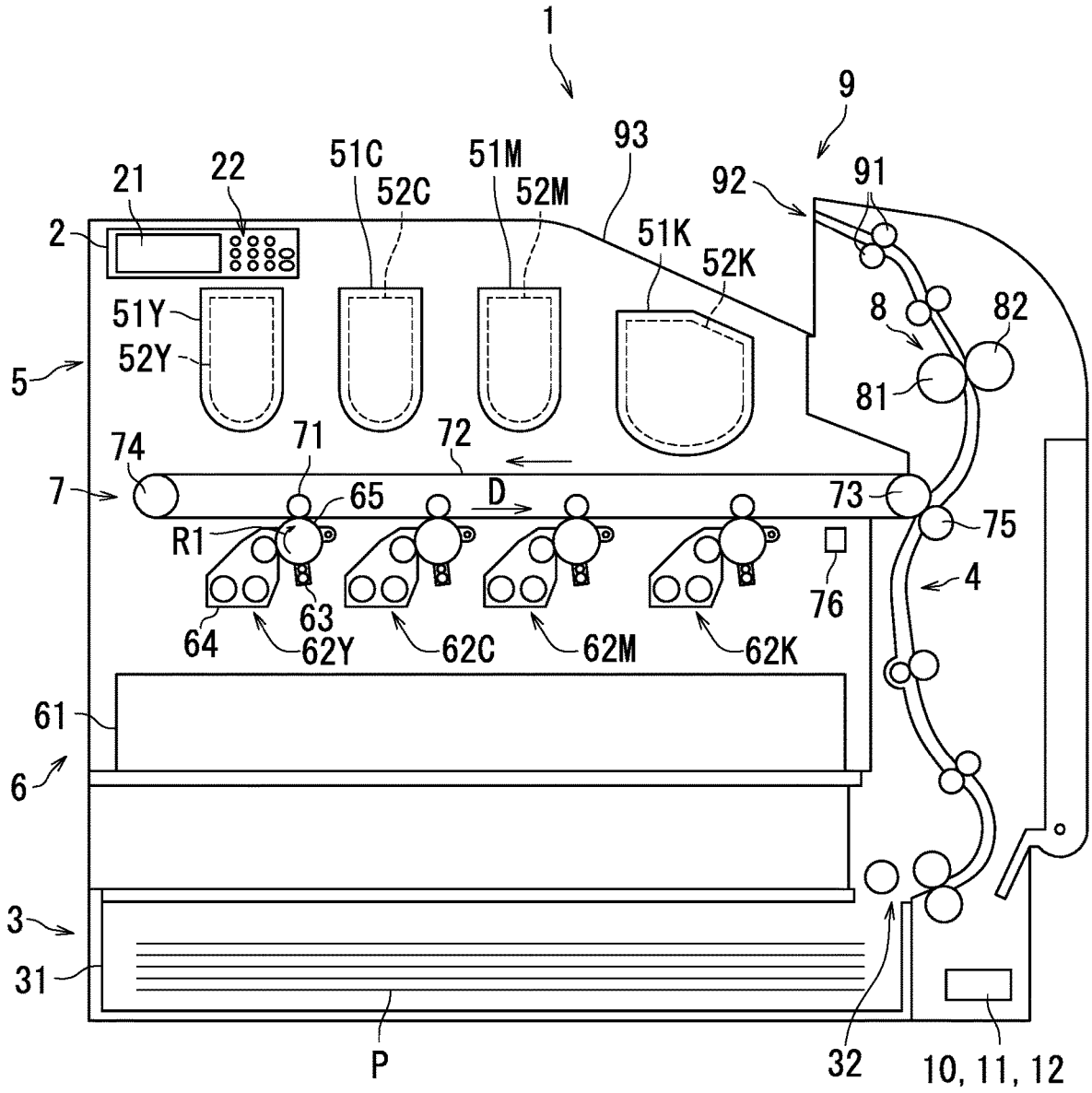
FIG. 1 is a diagram illustrating an example of a configuration of an image forming apparatus according to an embodiment of the present disclosure.

The following describes an embodiment of the present disclosure with reference to the accompanying drawings. Note that elements that are the same or equivalent are labeled with the same reference signs in the drawings and description thereof is not repeated.

A configuration of an image forming apparatus 1 according to the embodiment of the present disclosure is described with reference to FIG. 1. FIG. 1 is a diagram illustrating an example of the configuration of the image forming apparatus 1. The image forming apparatus 1 is a tandem color printer, for example.

As illustrated in FIG. 1, the image forming apparatus 1 includes an operation section 2, a sheet feed section 3, a conveyance section 4, a toner replenishing section 5, an image forming section 6, a transferring section 7, a fixing section 8, an ejection section 9, and a controller 10.

The operation section 2 receives an instruction from a user. Upon receiving the instruction from the user, the operation section 2 transmits a signal indicating the instruction from the user to the controller 10. The operation section 2 includes a liquid-crystal display 21 and a plurality of operation keys 22. The liquid-crystal display 21 displays various processing results, for example. The operation keys 22 include a numeric keypad and a start key, for example. When an instruction indicating execution of image formation processing is input, the operation section 2 transmits a signal indicating execution of the image formation processing to the controller 10. As a result, an image formation operation by the image forming apparatus 1 is started.

The sheet feed section 3 includes a sheet feed cassette 31 and a sheet feed roller group 32. The sheet feed cassette 31 houses a plurality of sheets P. The sheet feed roller group 32 feeds the sheets P housed in the sheet feed cassette 31 a sheet at a time to the conveyance section 4. Each sheet P is an example of a recording medium.

The conveyance section 4 includes a roller and a guide member. The conveyance section 4 extends from the sheet feed section 3 to the ejection section 9. The conveyance section 4 conveys the sheet P from the sheet feed section 3 to the ejection section 9 by way of the image forming section 6 and the fixing section 8.

The toner replenishing section 5 replenishes the image forming section 6 with toner. The toner replenishing section 5 includes a first attachment section 51Y, a second attachment section 51C, a third attachment section 51M, and a fourth attachment section 51K. The toner replenishing section 5 is an example of a developer supplying section. The toner is an example of a developer.

A first toner container 52Y is attached to the first attachment section 51Y. Similarly, a second toner container 52C is attached to the second attachment section 51C, a third toner container 52M is attached to the third attachment section 51M, and a fourth toner container 52K is attached to the fourth attachment section 51K. Note that the configurations of the first to fourth attachment sections 51Y to 51K are the same as each other aside from different types of toner container being attached thereto. As such, the first to fourth attachment sections 51Y to 51K may be generically referred to as an "attachment section Si".

The first toner container 52Y, the second toner container 52C, the third toner container 52M, and the fourth toner container 52K contain respective toners. In the present embodiment, the first toner container 52Y contains a yellow toner. The second toner container 52C contains a cyan toner. The third toner container 52M contains a magenta toner. The fourth toner container 52K contains a black toner.

The image forming section 6 includes a light exposure device 61, a first image forming unit 62Y, a second image forming unit 62C, a third image forming unit 62M, and a fourth image forming unit 62K.

Each of the first to fourth image forming units 62Y to 62K includes a charger 63, a development device 64, and a photosensitive drum 65. The photosensitive drum 65 is an example of an image bearing member.

The charger 63 and the development device 64 are arranged along the peripheral surface of the photosensitive drum 65. In the present embodiment, the photosensitive drum 65 rotates in a (clockwise) direction indicated by an arrow R1 in FIG. 1.

The charger 63 uniformly charges the photosensitive drum 65 to a prescribed polarity by electrical discharge. In the present embodiment, the charger 63 charges the photosensitive drum 65 to a positive polarity. The light exposure device 61 emits laser light to the charged photosensitive drum 65. Through the above, an electrostatic latent image is formed on the surface of the photosensitive drum 65.

The development device 64 develops the electrostatic latent image formed on the surface of the photosensitive drum 65 into a toner image. The development device 64 is replenished with a toner from the toner replenishing section 5. The development device 64 supplies the toner supplied from the toner replenishing section 5 to the surface of the photosensitive drum 65. As a result, a toner image is formed on the surface of the photosensitive drum 65.

In the present embodiment, the development device 64 in the first image forming unit 62Y is connected to the first attachment section 51Y. In the above configuration, the yellow toner is supplied to the development device 64 in the first image forming unit 62Y. As a result, a yellow toner image is formed on the surface of the photosensitive drum 65 in the first image forming unit 62Y.

The development device 64 in the second image forming unit 62C is connected to the second attachment section 51C. In the above configuration, the cyan toner is supplied to the development device 64 in the second image forming unit 62C. As a result, a cyan toner image is formed on the surface of the photosensitive drum 65 in the second image forming unit 62C.

The development device 64 in the third image forming unit 62M is connected to the third attachment section 51M. In the above configuration, the magenta toner is supplied to the development device 64 in the third image forming unit 62M. As a result, a magenta toner image is formed on the surface of the photosensitive drum 65 in the third image forming unit 62M.

The development device 64 in the fourth image forming unit 62K is connected to the fourth attachment section 51K. In the above configuration, the black toner is supplied to the development device 64 in the fourth image forming unit 62K. As a result, a black toner image is formed on the surface of the photosensitive drum 65 in the fourth image forming unit 62K.

The transferring section 7 transfers to a sheet P the toner images formed on the surfaces of the respective photosensitive drums 65 in the first to fourth image forming units 62Y to 62K in a superimposed manner. In the present embodiment, the transferring section 7 transfers the toner images to the sheet P in a superimposed manner by secondary transfer. In detail, the transferring section 7 includes four primary transfer rollers 71, an intermediate transfer belt 72, a drive roller 73, a driven roller 74, a secondary transfer roller 75, and a density sensor 76.

The intermediate transfer belt 72 is an endless belt stretched between the four primary transfer rollers 71, the drive roller 73, and the driven roller 74. The intermediate transfer belt 72 is driven according to the rotation of the drive roller 73. In FIG. 1, the intermediate transfer belt 72 circles counterclockwise. The driven roller 74 is driven to rotate according to the circling of the intermediate transfer belt 72.

The first to fourth image forming units 62Y to 62K are arranged in a moving direction D of the lower surface of the intermediate transfer belt 72 so as to be opposite to the lower surface of the intermediate transfer belt 72. In the present embodiment, the first, second, third, and fourth image forming units 62Y, 62C, 62M, and 62K are arranged in order from upstream to downstream in the moving direction D of the lower surface of the intermediate transfer belt 72.

Each of the primary transfer rollers 71 is arranged opposite to a corresponding one of the photosensitive drums 65 with the intermediate transfer belt 72 therebetween and pressed against the photosensitive drum 65. As such, the toner image formed on the surface of each photosensitive drum 65 is sequentially transferred to the intermediate transfer belt 72. In the present embodiment, the yellow toner image, the cyan toner image, the magenta toner image, and the black toner image are transferred in the stated order to the intermediate transfer belt 72 in a superimposed manner. In the following, a toner image generated by superimposing the yellow toner image, the cyan toner image, the magenta toner image, and the black toner image may be referred to as a "layered toner image".

The secondary transfer roller 75 is arranged opposite to the drive roller 73 with the intermediate transfer belt 72 therebetween. The secondary transfer roller 75 is pressed against the drive roller 73. Accordingly, a transfer nip is formed between the secondary transfer roller 75 and the drive roller 73. When the sheet P passes through the transfer nip, the layered toner image on the intermediate transfer belt 72 is transferred to the sheet P. In the present embodiment, the yellow toner image, the cyan toner image, the magenta toner image, and the black toner image are transferred to the sheet P so as to be superimposed in the stated order from a top layer to a bottom layer. The sheet P to which the layered toner image has been transferred is conveyed to the fixing section 8 by the conveyance section 4.

The density sensor 76 is arranged opposite to the intermediate transfer belt 72 downstream of the first to fourth image forming units 62Y to 62K and measures the density of the layered toner image formed on the photosensitive drum 65 72. Note that the density sensor 76 may measure the density of the layered toner image on the intermediate transfer belt 72 or may measure the density of a toner image fixed to the sheet P.

The fixing section 8 includes a heating member 81 and a pressure member 82. The heating member 81 and the pressure member 82 are arranged opposite to each other and form a fixing nip. The sheet P conveyed from the image forming section 6 receives pressure while being heated to a prescribed temperature by passing through the fixing nip. As a result, the layered toner image is fixed to the sheet P. The sheet P is conveyed from the fixing section 8 to the ejection section 9 by the conveyance section 4.

The ejection section 9 includes an ejection roller pair 91 and an exit tray 93. The ejection roller pair 91 conveys the sheet P to the exit tray 93 through an exit port 92. The exit port 92 is formed in an upper part of the image forming apparatus 1.

The controller 10 controls the operation of each element included in the image forming apparatus 1. The controller 10 includes a processor 11 and storage 12. The processor 11 includes a central processing unit (CPU), for example. The storage 12 includes memory such as semiconductor memory and may include a hard disk drive (HDD). The storage 12 stores a control program therein. The processor 11 controls the operation of the image forming apparatus 1 by executing the control program.

Figure 2:
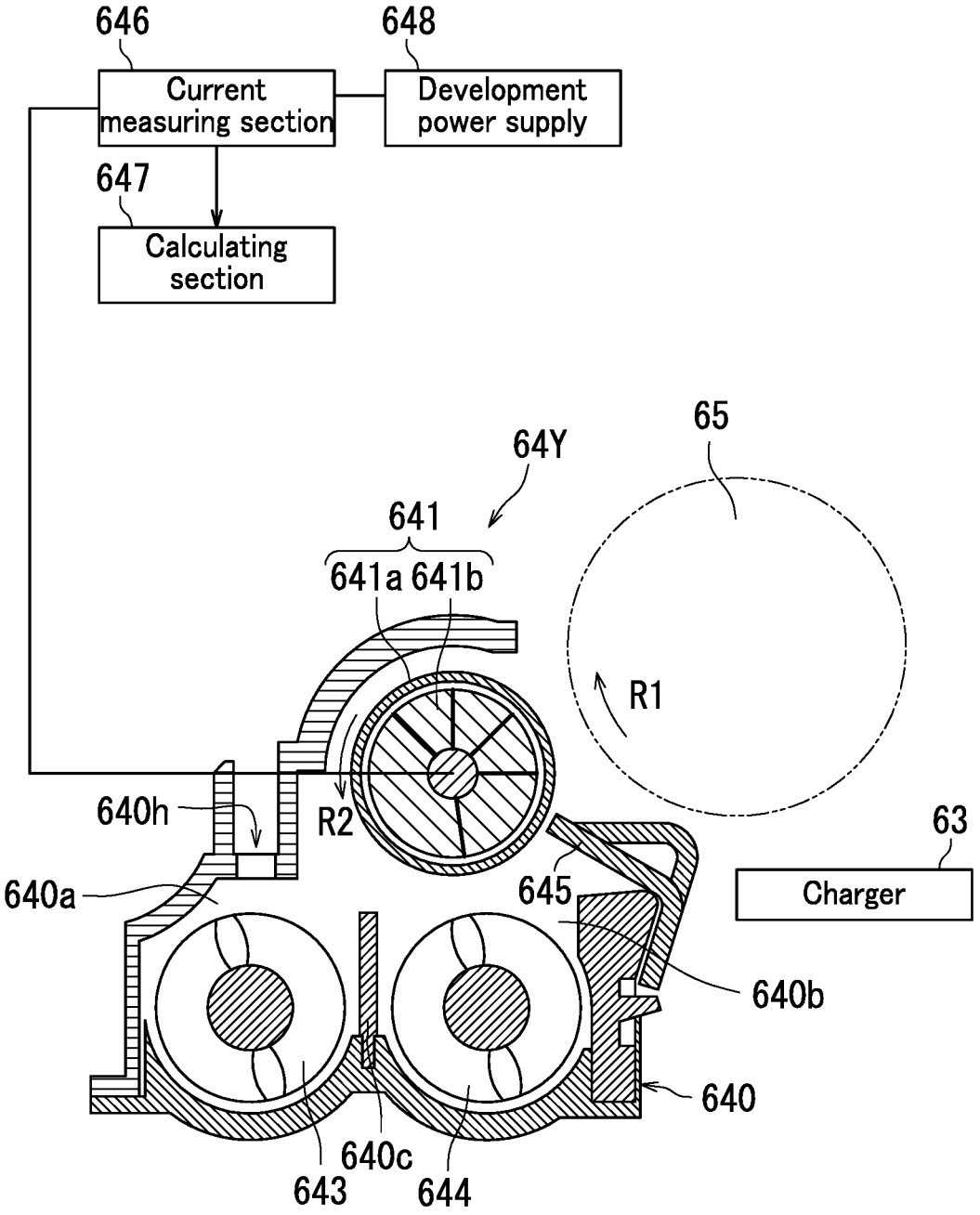
FIG. 2 is a diagram illustrating an example of a configuration of a development device in the embodiment.

Next, a configuration of a development device 64 is described in detail with reference to FIG. 2. FIG. 2 is a diagram illustrating an example of the configuration of the development device 64. In detail, FIG. 2 illustrates the first development device 64Y in the first image forming unit 62Y. Note that in FIG. 2, the photosensitive drum 65 is illustrated with a dashed and double dotted line to facilitate understanding. In the present embodiment, the first development device 64Y develops an electrostatic latent image formed on the surface of the photosensitive drum 65 using two-component development. A developer container 640 of the first development device 64Y is connected to the first toner container 52Y. Accordingly, the yellow toner is supplied to the developer container 640 of the first development device 64Y through a toner replenishment port 640*h*.

As illustrated in FIG. 2, the first development device 64Y includes a development roller 641, a first stirring screw 643, a second stirring screw 644, and a blade 645 inside the developer container 640. In detail, the development roller 641 is arranged opposite to the second stirring screw 644. The blade 645 is arranged opposite to the development roller 641.

The developer container 640 is divided into a first stirring compartment 640*a* and a second stirring compartment 640*b* by a dividing wall 640*c*. The dividing wall 640*c* extends in the axial direction of the development roller 641. The first stirring compartment 640*a* and the second stirring compartment 640*b* communicate with each other outside each of the opposite ends of the dividing wall 640*c* in the longitudinal direction thereof.

The first stirring screw 643 is arranged in the first stirring compartment 640*a*. A magnetic carrier is housed in the first stirring compartment 640*a*. A non-magnetic toner is supplied to the first stirring compartment 640*a* through the toner replenishment port 640*h*. In the example illustrated in FIG. 2, the yellow toner is supplied to the first stirring compartment 640*a*.

The second stirring screw 644 is arranged in the second stirring compartment 640*b*. A magnetic carrier is housed in the second stirring compartment 640*b*.

The yellow toner is stirred and mixed with the carrier by the first stirring screw 643 and the second stirring screw 644. As a result, a two-component developer is generated from the carrier and the yellow toner. Because the two-component developer is an example of a developer, the two-component developer may be referred to in the following simply as a "developer".

The first stirring screw 643 and the second stirring screw 644 stir the developer by circulating the developer between the first stirring compartment 640*a* and the second stirring compartment 640*b*. As a result, the toner is charged to a prescribed polarity. In the present embodiment, the toner is charged to a positive polarity.

The development roller 641 includes a non-magnetic rotating sleeve 641*a* and a magnetic body 641*b*. The magnetic body 641*b* is secured and arranged inside the rotating sleeve 641*a*. The magnetic body 641*b* has a plurality of magnetic poles. The developer is attracted to the development roller 641 through the magnetic force of the magnetic body 641*b*. As a result, a magnetic brush is formed on the surface of the development roller 641.

In the present embodiment, the development roller 641 rotates in a (counterclockwise) direction indicated by an arrow R2 in FIG. 2. The development roller 641 conveys the magnetic brush to a position opposite to the blade 645 by rotating. The blade 645 is arranged such that a gap (space) is formed between the development roller 641 and the blade 645. Accordingly, the thickness of the magnetic brush is defined by the blade 645. The blade 645 is arranged upstream in the rotational direction of the development roller 641 of a position at which the development roller 641 and the photosensitive drum 65 are opposite to each other.

A prescribed voltage is applied to the development roller 641. Thus, a layer of the developer formed on the surface of the development roller 641 is conveyed to a position opposite to the photosensitive drum 65 and the toner in the developer is attached to the photosensitive drum 65.

Specifically, the first development device 64Y further includes an electric current measuring section 646, a calculating section 647, and a development power supply 648.

The electric current measuring section 646 is connected between the development power supply 648 and the development roller 641, for example. The development power supply 648 applies a prescribed bias voltage to the development roller 641 of the first development device 64Y. The electric current measuring section 646 measures a development current flowing between the photosensitive drum 65 and the development roller 641 according to the bias voltage applied by the development power supply 648. The electric current measuring section 646 is an ammeter, for example, and measures the electric current value of the development current. The calculating section 647 includes a central processing unit (CPU), for example. The CPU functions as the calculating section 647 through the processor 11 executing the control program. Note that the CPU functioning as the calculating section 647 may be the processor 11.

Figure 3A:
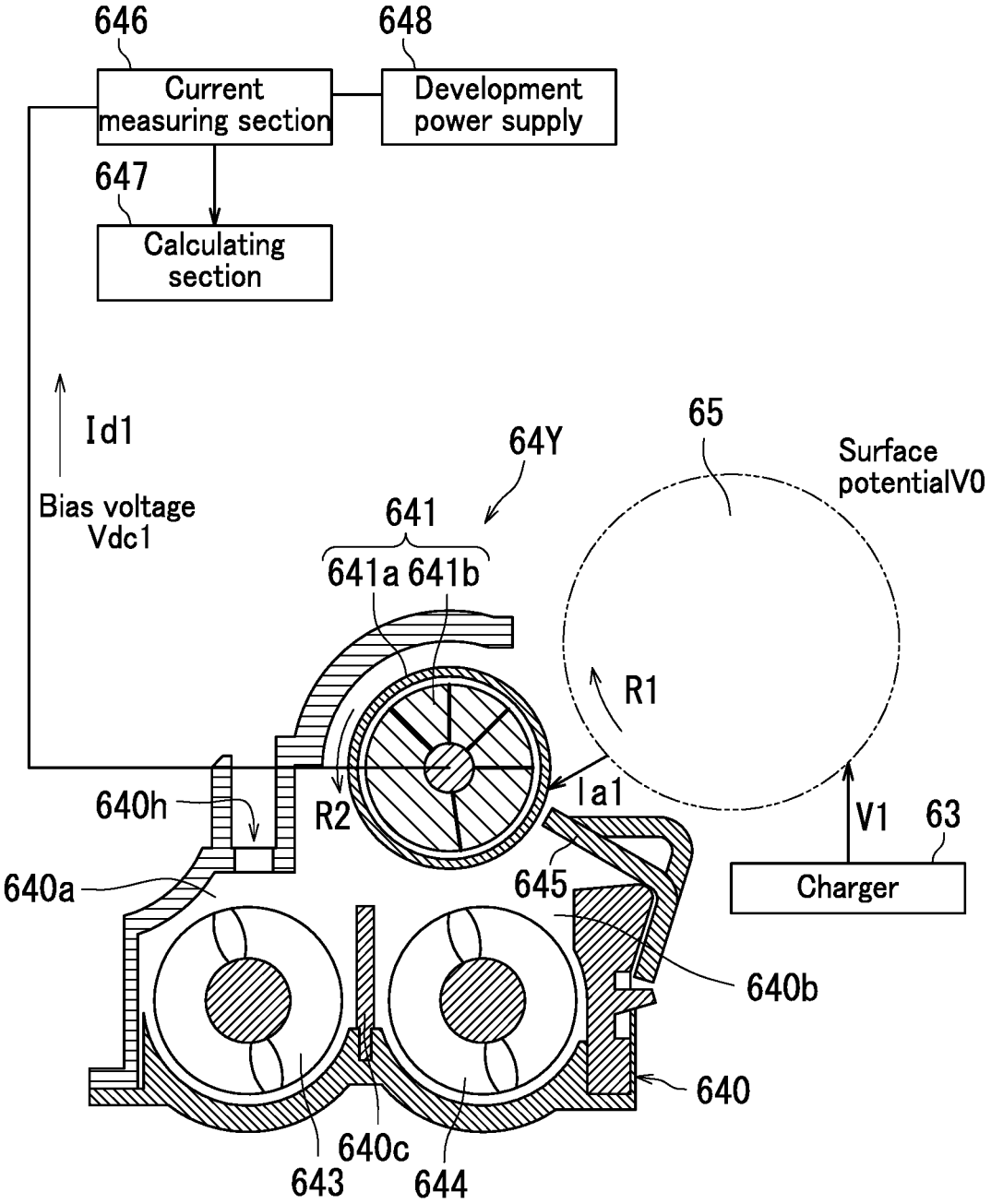
FIG. 3A is a diagram illustrating a development current measured by an electric current measuring section in the embodiment.
Figure 3B:
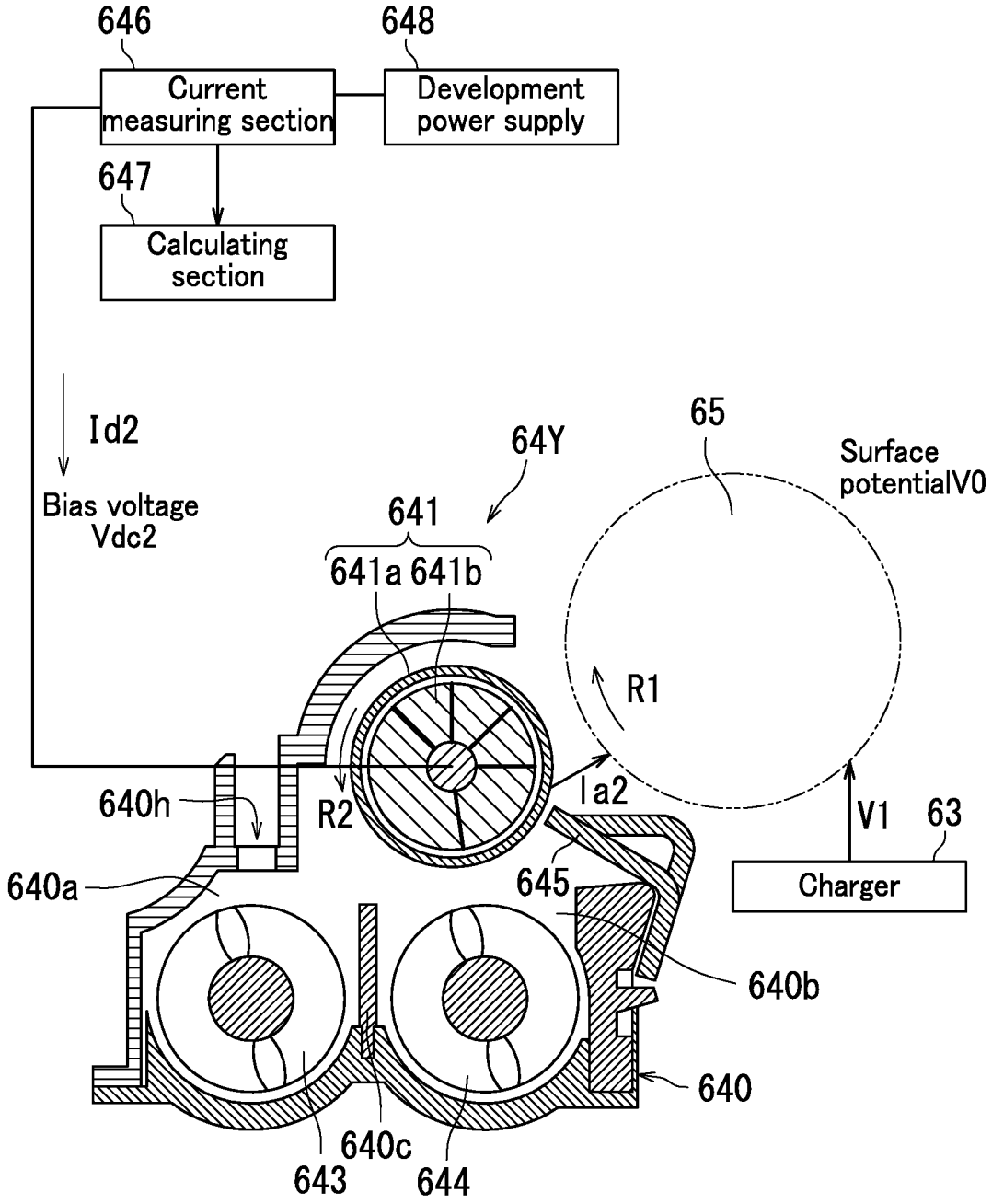
FIG. 3B is another diagram illustrating a development current measured by the electric current measuring section.

Next, the development current flowing in the first development device 64Y is described with reference to FIGS. 3A and 3B. FIGS. 3A and 3B are diagrams each illustrating the development current measured by the electric current measuring section 646.

For example, the electric current measuring section 646 measures the electric current value of the development current while the first development device 64Y is developing an electrostatic latent image formed on the surface of the photosensitive drum 65.

In the present embodiment, when the user inputs an instruction indicating execution of the image formation processing to the image forming apparatus 1, the controller 10 causes the image forming section 6 to start an image formation operation with corresponding elements included in the image forming apparatus 1. Specifically, the controller 10 controls the charger 63, the first development device 64Y, the development power supply 648, and the light exposure device 61.

The charger 63 charges the surface of the photosensitive drum 65 to a prescribed charge potential (surface potential V0) under control of the controller 10. In detail, when the charger 63 applies a charging bias to the photosensitive drum 65, the surface of the photosensitive drum 65 is charged to the surface potential V0.

The development power supply 648 applies a bias voltage to the development roller 641 under control of the controller 10. The bias voltage includes a direct current (DC) component and an alternating current (AC) component. FIG. 3A illustrates a case in which a bias voltage Vdc1 with a DC component having a potential smaller than the surface potential V0 is applied to the development roller 641. Note that the bias voltage may include no AC component.

The light exposure device 61 emits laser light to the photosensitive drum 65 charged to the surface potential V0 by the charger 63 under control of the controller 10. Thus, an electrostatic latent image is formed on the surface of the photosensitive drum 65.

Once an electrostatic latent image is formed on the surface of the photosensitive drum 65, the first development device 64Y develops the electrostatic latent image formed on the surface of the photosensitive drum 65 under the control of controller 10.

At this time, the electric current measuring section 646 measures the electric current value of the development current. In FIG. 3A, a development current Id1 is a combined electric current including an electric current that flows when toner in the magnetic brush formed on the development roller 641 moves to the development roller 641 and an electric current Ia1 that flows from the photosensitive drum 65 through the magnetic brush formed on the development roller 641.

FIG. 3B illustrates a case in which a DC component of a bias voltage (Vdc2) having a potential greater than the surface potential V0 is applied to the development roller 641. In FIG. 3B, a development current Id2 is a combined electric current including an electric current Ia2 that flows when the toner is supplied to the photosensitive drum 65 and an electric current that flows to the photosensitive drum 65 through the magnetic brush formed on the development roller 641.

As such, when the DC component of the bias voltage has a potential greater than the surface potential V0, the direction of the development current measured by the electric current measuring section 646 is reversed from the case in which the DC component of the bias voltage has a potential smaller than the surface potential V0.

Furthermore, when the DC component of the bias voltage has a potential equal to the surface potential V0, the development electric field intensity is zero and the development current is zero. Because of this, the potential of the DC component of the bias voltage is determined to be the surface potential V0 when the development current is zero.

Figure 4:
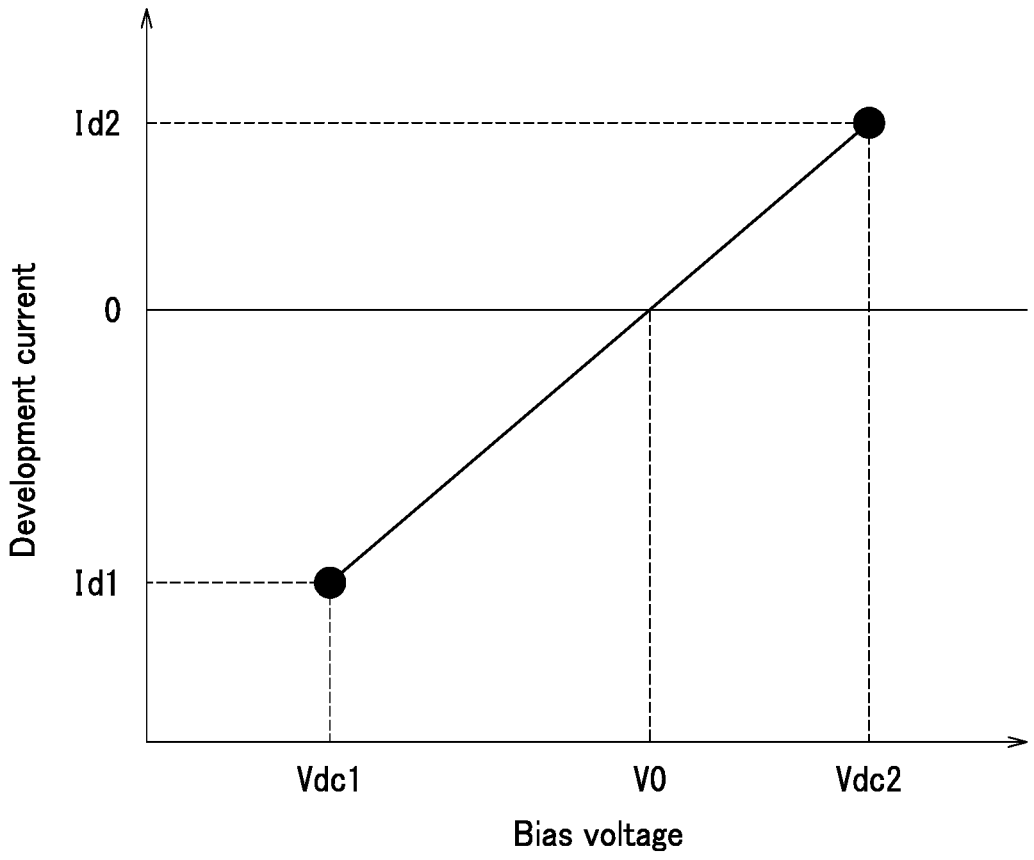
FIG. 4 is a graph illustrating a correspondence between the development current and a bias voltage.

Next, surface potential calculation is described with reference to FIGS. 3A, 3B, and 4. FIG. 4 is a graph illustrating a correspondence between the development current and the bias voltage. In FIG. 4, the vertical axis indicates the development current and the horizontal axis indicates the bias voltage.

For example, the development power supply 648 applies a bias voltage Vdc1 to the development roller 641. In the above bias voltage application, the electric current measuring section 646 measures the electric current value of the development current Id1. The calculating section 647 acquires the bias voltage Vdc1 being applied by the development power supply 648 and the electric current value of the development current Id1 measured by the electric current measuring section 646 (FIG. 3A).

The development power supply 648 then applies a bias voltage Vdc2 to the development roller 641. In the above bias voltage application, the electric current measuring section 646 measures the electric current value of a development current Id2. The calculating section 647 acquires the bias voltage Vdc2 being applied by the development power supply 648 and the electric current value of the development current Id2 measured by the electric current measuring section 646 (FIG. 3B).

The calculating section 647 calculates as the surface potential V0 a bias voltage at which the development current stops flowing based on the bias voltage Vdc1, the development current Id1, the bias voltage Vdc2, and the development current Id2 thus obtained.

In the present embodiment, the configuration of the development devices 64 included in the respective first to fourth image forming units 62Y to 62K is substantially identical aside from the type of toner being supplied thereto from the toner replenishing sections 5. Accordingly, description of the configuration of the second to fourth development devices 64C to 64K in the respective second to fourth image forming units 62C to 62K is omitted.

For example, the controller 10 determines a bias voltage Vdc to be applied to the development roller 641 by the development power supply 648 based on the surface potential V0 calculated by the calculating section 647.

This can enable application of the bias voltage with an appropriate potential difference to the development roller 641 in electrostatic latent image development, thereby achieving high-quality image formation.

Surface potential calculation as above is performed for example before the controller 10 causes the image forming section 6 to start the image formation operation in response to the user inputting an instruction to execute the image formation processing to the image forming apparatus 1.

However, it takes time to calculate the surface potential because it is necessary to apply a multi-stage bias voltage to the development roller 641.

Furthermore, in a case of image formation on a large number of sheets, variation in surface potential during the image formation cannot be understood.

In view of the foregoing, a method is considered in which the surface potential is calculated through measurement of a development current in a period between when the image forming section 6 forms an image on a given sheet P and when the image forming section forms an image on the next sheet P.

Specifically, when the user inputs an instruction to execute image formation processing on a plurality of sheets to the image forming apparatus 1, the controller 10 causes the image forming section 6 to start the image formation operation sequentially on the sheets P. In this case, the development device 64 sequentially forms a plurality of image formation toner images F. Each of the image formation toner images F is a toner image for image formation on a corresponding sheet P. The electric current measuring section 646 measurers the electric current value of the development current in each period T during which the image formation toner images are not formed.

Figure 5:
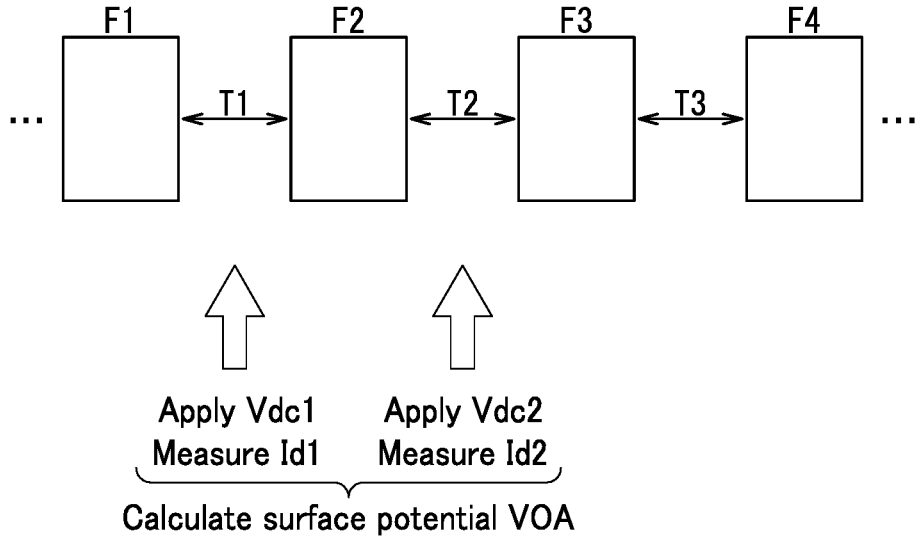
FIG. 5 is a diagram schematically illustrating development current measurement in periods and surface potential calculation based on the measured development currents.

Next, development current measurement in the periods T and surface potential to be calculated is described with reference to FIG. 5. FIG. 5 is a diagram schematically illustrating development current measurement in the respective periods T and surface potential calculation based on the measured development currents.

For example, the controller 10 causes the development power supply 648 to apply a bias voltage Vdc1 to the development roller 641 during a period T1 between formation of an image formation toner image F1 and formation of an image formation toner image F2. Here, the bias voltage Vdc1 may be the same (e.g., 500 V) as or different (e.g., 300 V) from a bias voltage applied to the development roller 641 during formation of the image formation toner image F1. In the above bias voltage application, the electric current measuring section 646 measures the electric current value of the development current Id1. The calculating section 647 acquires the bias voltage Vdc1 being applied by the development power supply 648 and the electric current value of the development current Id1 measured by the electric current measuring section 646.

The controller 10 then causes the development power supply 648 to apply a bias voltage Vdc2 to the development roller 641 during a period T2 between formation of the image formation toner image F2 and formation of an image formation toner image F3. In the above bias voltage application, the electric current value of the development current Id2 is measured by the electric current measuring section 646. In other words, the electric current measuring section 646 measures the electric current value of the development current Id2. The calculating section 647 acquires the bias voltage Vdc2 being applied by the development power supply 648 and the electric current value of the development current Id2 measured by the electric current measuring section 646.

The calculating section 647 calculates as a surface potential VOA a bias voltage at which the development current stops flowing based on the bias voltage Vdc1, the development current Id1, the bias voltage Vdc2, and the development current Id2 thus obtained.

Note that in addition to the bias voltage Vdc1, the development current Id1, the bias voltage Vdc2, and the development current Id2 thus obtained, the calculating section 647 may obtain a bias voltage being applied by the development power supply 648 and the electric current value of the development current measured by the electric current measuring section 646 in a period T3 between formation of the image formation toner image F3 and formation of an image formation toner image F4 to calculate a surface potential VOA based on the bias voltage Vdc1, the development current Id1, the bias voltage Vdc2, the development current Id2, and the bias voltage and development current in the period T3 thus obtained.

Furthermore, a multi-stage bias voltage may be applied to the development roller 641 in a single period T in the present embodiment. In this case, the calculating section 647 acquires development currents according to the respective voltages of the multi-stage bias voltage and calculates the surface potential VOA.

Yet, in the present embodiment, the light exposure device 61 does not irradiate the photosensitive drum 65 with laser light during development current measurement by the electric current measuring section 646 in each period T. Because the development current is measured through utilization of an unexposed area of the photosensitive drum 65 as above, which means utilization of a blank area of the photosensitive drum 65 where toner scattering occurs little, the development current includes mainly an electric current caused due to movement of a carrier. Accordingly, the surface potential of the photosensitive drum 65 can be measured with high accuracy. Note that the surface potential may be calculated through measurement of the development current by utilizing an exposed area of the photosensitive drum 65 that the light exposure device 61 irradiates with laser light irradiation.

In addition, the calculating section 647 calculates as the surface potential a bias voltage at which the development current stops flowing in the present embodiment. However, the present disclosure is not limited as such, and the calculating section 647 may calculate as the surface potential a bias voltage at which a development current flows that is as large as the development current that flows when the surface of the photosensitive drum 65 is not charged.

[Case of Formation of Images Including High Coverage Rate Image]

In a case in which images including a high coverage rate image are formed on sheets P in the present embodiment, the density of a toner image temporarily decreases in a period T directly after formation of the high coverage rate image. This reduces accuracy of surface potential calculation.

In view of the foregoing, in a case in which an image having a coverage rate higher than a prescribed threshold is formed, the controller 10 controls the calculating section 647 so as not to use the bias voltage being applied to the development roller 641 and the development current measured by the electric current measuring section 646 for surface potential calculation in a period T directly after formation of an image formation toner image F corresponding to the image having a coverage rate higher than the prescribed threshold.

Specifically, when an instruction to execute image formation on multiple sheets is input to the image forming apparatus 1, the controller 10 acquires coverage rates of the images to be formed on the respective sheets P by referring to image data for the image formation, and acquires, when a coverage rate higher than the prescribed threshold is present among the obtained coverage rates, the turn at which an image having the coverage rate is to be formed.

The controller 10 controls the calculating section 647 so as not to obtain the development current measured by the electric current measuring section 646 in a period T directly after formation of an image formation toner image F corresponding to the image of the obtained turn.

Figure 6:
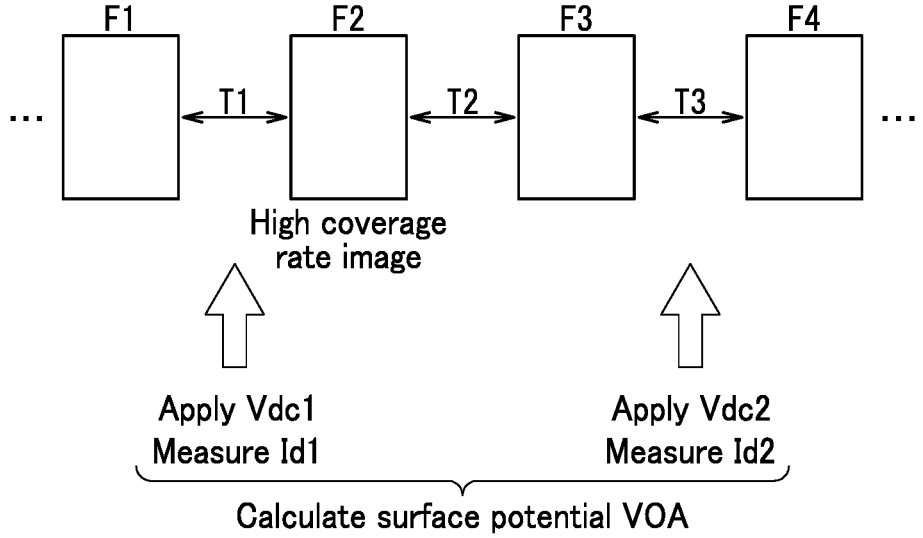
FIG. 6 is a diagram schematically illustrating surface potential calculation in a case in which images including a high coverage rate image are formed on sheets.

Surface potential calculation in a case in which images including a high coverage rate image are formed on sheets P is described next with reference to FIG. 6. FIG. 6 is a diagram schematically illustrating surface potential calculation in a case in which images including a high coverage rate image are formed on sheets P.

For example, the controller 10 causes the development power supply 648 to apply the bias voltage Vdc1 to the development roller 641 during a period T1. In the above bias voltage application, the electric current measuring section 646 measures the electric current value of the development current Id1. The calculating section 647 acquires a bias voltage Vdc1 being applied by the development power supply 648 and the electric current value of the development current Id1 measured by the electric current measuring section 646.

Furthermore, the controller 10 for example controls the calculating section 647 so as not to obtain the development current measured by the electric current measuring section 646 in a period T2 directly after formation of an image formation toner image F2 corresponding to the image having a coverage rate higher than the prescribed threshold.

The controller 10 then causes the development power supply 648 to apply the bias voltage Vdc2 to the development roller 641 during a period T3. In the above bias voltage application, a development current Id2 is measured by the electric current measuring section 646. In other words, the electric current measuring section 646 measures an electric current value of the development current Id2. The calculating section 647 acquires the bias voltage Vdc2 being applied by the development power supply 648 and the electric current value of the development current Id2 measured by the electric current measuring section 646.

The calculating section 647 calculates as the surface potential VOA a bias voltage at which the development current stops flowing based on the bias voltage Vdc1, the development current Id1, the bias voltage Vdc2, and the development current Id2 thus obtained. [Bias Voltage Setting in Formation of Image Formation Toner Image]

The controller 10 sets the bias voltage to be applied by the development power supply 648 in formation of an image formation toner image F based on the surface potential calculated by the calculating section 647 in the present embodiment.

Figure 7:
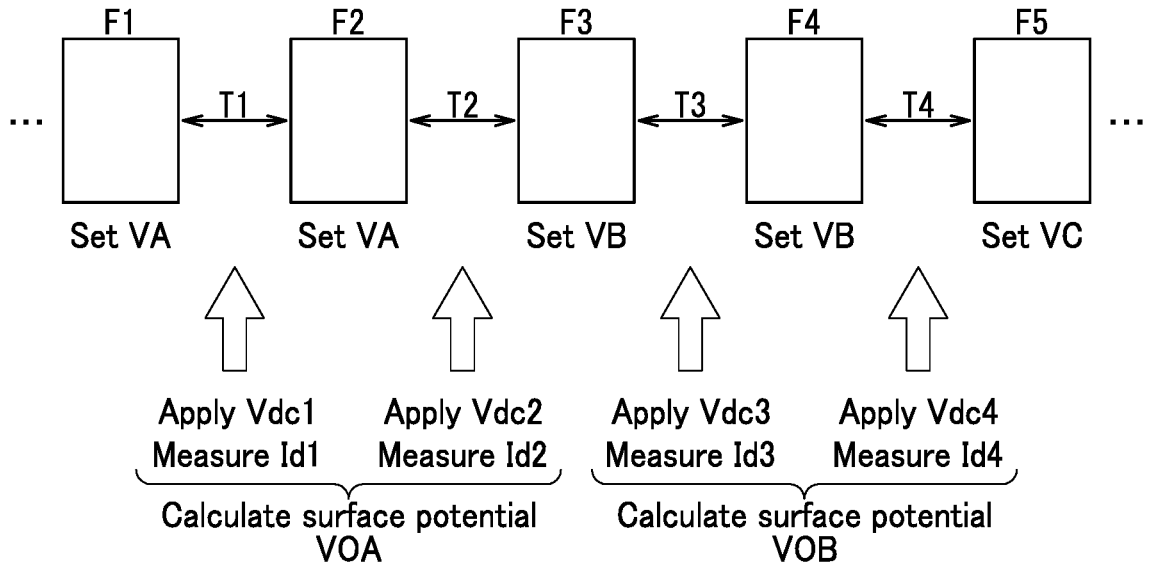
FIG. 7 is a diagram schematically illustrating bias voltage setting in formation of image formation toner images.

Bias voltages in formation of image formation toner images F is described next with reference to FIG. 7. FIG. 7 is a diagram schematically illustrating bias voltage setting in formation of the image formation toner images F.

For example, a bias voltage VA is applied to the development roller 641 during formation of an image formation toner image F1. A bias voltage Vdc1 is applied to the development roller 641 and the development current Id1 is measured in the period T1. A bias voltage Vdc2 is applied to the development roller 641 and the development current Id2 is measured in the period T2. Then, a surface potential VOA is calculated.

The controller 10 sets based on the surface potential VOA calculated by the calculating section 647 a bias voltage VB that is to be applied to the development roller 641 during formation of an image formation toner image F3 that is to be formed next.

Furthermore, the controller 10 determines based on the bias voltage VB a bias voltage Vdc3 that is to be applied to the development roller 641 in a period T3 and a bias voltage Vdc4 that is to be applied to the development roller 641 in a period T4.

Accordingly, a development current Id3 is measured in the period T3, a development current Id4 is measured in the period T4, and a surface potential V0B is calculated.

The controller 10 sets based on the surface potential V0B calculated by the calculating section 647 a bias voltage VC that is to be applied to the development roller 641 during formation of an image formation toner image F5 that is to be formed next.

Figure 8:
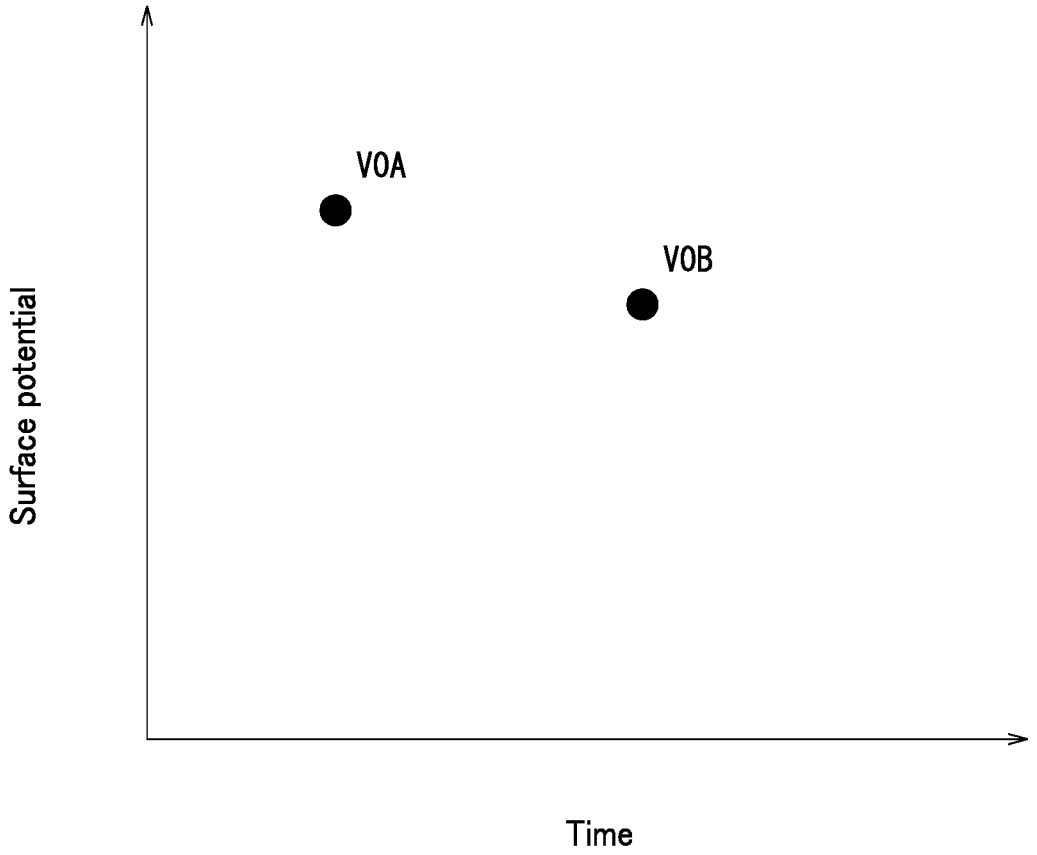
FIG. 8 is a diagram illustrating a shift in a surface potential following formation of the image formation toner images.

FIG. 8 is a diagram illustrating a shift in the surface potential following formation of image formation toner images F. In FIG. 8, the vertical axis indicates the surface potential and the horizontal axis indicates time in which the surface potential is calculated.

As illustrated in FIG. 8, surface potential calculation in periods T can result in awareness of a shift in the surface potential during image formation on a plurality of sheets P. This can contribute to prediction of degradation of elements such as the charger 63 and the photosensitive drum 65.

When the calculated surface potential V0B is higher or lower than the surface potential VOA by a prescribed reference value, for example, the calculating section 647 determines that the calculated surface potential V0B is a measurement error in the present embodiment. In this case, the calculating section 647 may re-calculate the surface potential or use the surface potential VOA as a result of calculation.

Figure 9:
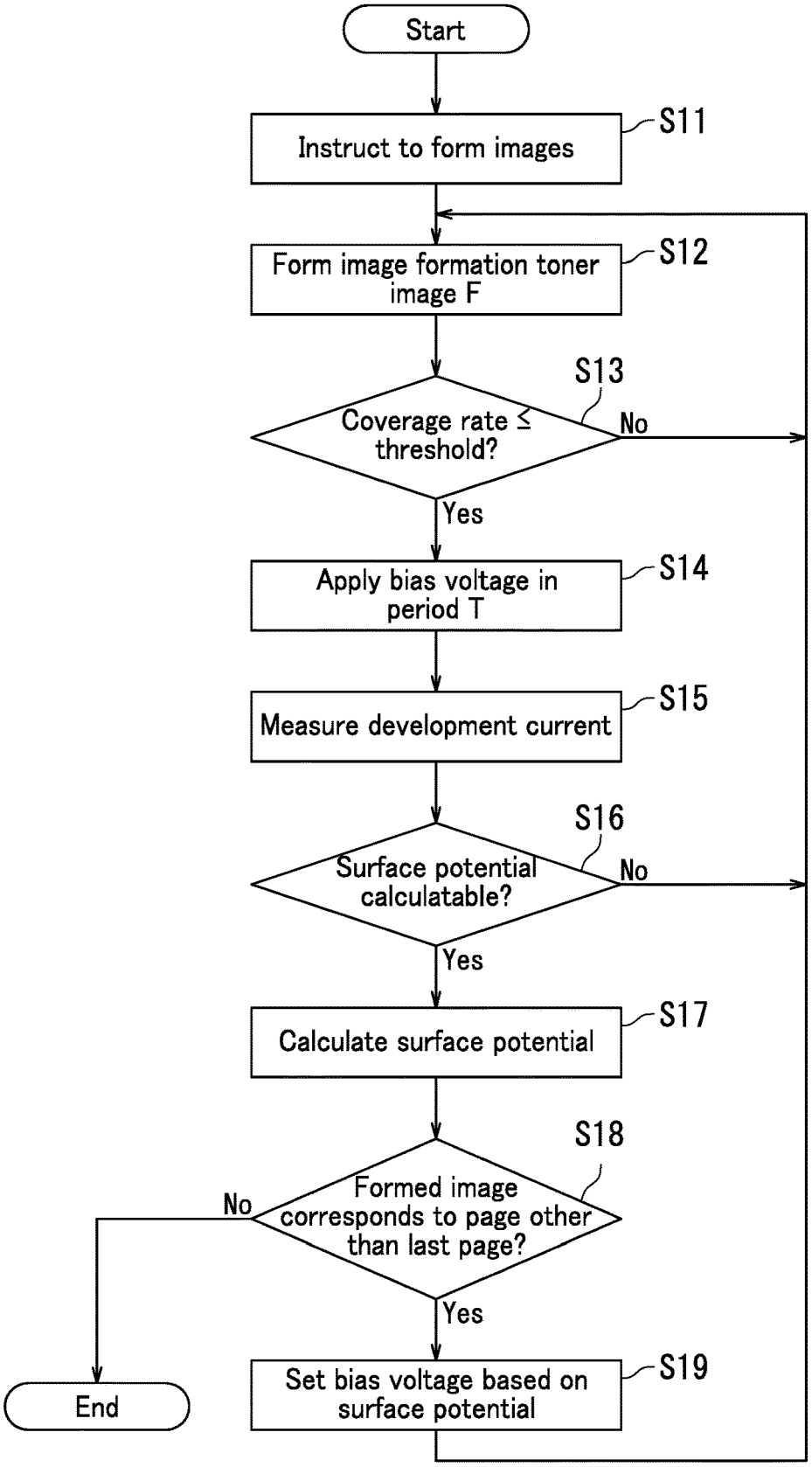
FIG. 9 is a flowchart depicting a process of surface potential calculation according to the embodiment.

A process of surface potential calculation according to the present embodiment is described next with reference to FIG. 9. FIG. 9 is a flowchart depicting the process of surface potential calculation according to the present embodiment.

First, when the user inputs an instruction to execute formation of images on a plurality of sheets to the image forming apparatus 1 (Step S11), the development device 64 forms an image formation toner image F (Step S12).

When the image formation toner image F formed by the development device 64 has a coverage rate higher than the prescribed threshold (No in Step S13), the controller 10 causes the development device 64 to form the next image formation toner image F (step S12).

When the image formation toner image F formed by the development device 64 has a coverage rate lower than or equal to the prescribed threshold by contrast (Yes in Step S13), the controller 10 causes the development power supply to apply the bias voltage to the development roller 641 in a period T directly thereafter (Step S14).

The electric current measuring section 646 measures the development current in the period T (Step S15).

When the measured development current is inadequate for surface potential calculation by the calculation section 647 (No in Step S16), the controller 10 causes the development device 64 to form the next image formation toner image F (Step S12).

When the measured development current is adequate for surface potential calculation by the calculation section 64 by contrast (Yes in Step S16), the controller 10 causes the calculating section 647 to perform surface potential calculation (Step S17).

When the image formation toner image F formed by the development device 64 does not correspond to an image of the last page (No in Step S18), the controller 10 sets a bias voltage to be applied to the development roller 641 during formation of the next image formation toner image F (Step S19), and then causes the development device 64 to form the next image formation toner image F.

When the image formation toner image F formed by the development device 64 corresponds to an image of the last page by contrast (Yes in Step S18), the controller 10 terminates control of image formation.

EXAMPLE

Specific description of the present disclosure is made below based on Example.

However, the present disclosure is not limited to Example as below.

In Example of the present disclosure, a multifunction peripheral was used as the image forming apparatus 1. The multifunction peripheral was a remodeled TASKalfa 2550Ci (product of KYOCERA Document Solutions Inc.).

The test conditions of the multifunction peripheral were as follows.

Photosensitive drum 65: amorphous silicon (a-Si) drum
Thickness of photosensitive drum 65: 20 μm
Charger 63: outer diameter of metal core of charging roller—6 mm, rubber thickness—3 mm, rubber resistance—6.0 Log Ω
Charging bias: DC only
Blade 643: SUS 450, magnetic
Thickness of blade 643: 1.5 mm
Surface profile of development roller 641: subjected to knurling and blasting
Outer diameter of development roller 641: 20 mm
Recess of development roller 641: 80 rows in circumferential direction
Peripheral speed of development roller 641/peripheral speed of photosensitive drum 65: 1.8
Distance between development roller 641 and photosensitive drum 65: 0.30 mm
AC component of bias voltage: Vpp 1200 V, duty 50%, rectangular waveform, 8 kHz
Toner: particle diameter 6.8 μm, positively chargeable
Carrier: particle diameter 38 μm, ferrite resin coated carrier
Toner density: 6%
Printing speed: 55 sheets/minute The surface potential calculated in the image forming apparatus 1 according to Example is described next with reference to FIGS. 10 and 11.

Figures 10, 11:
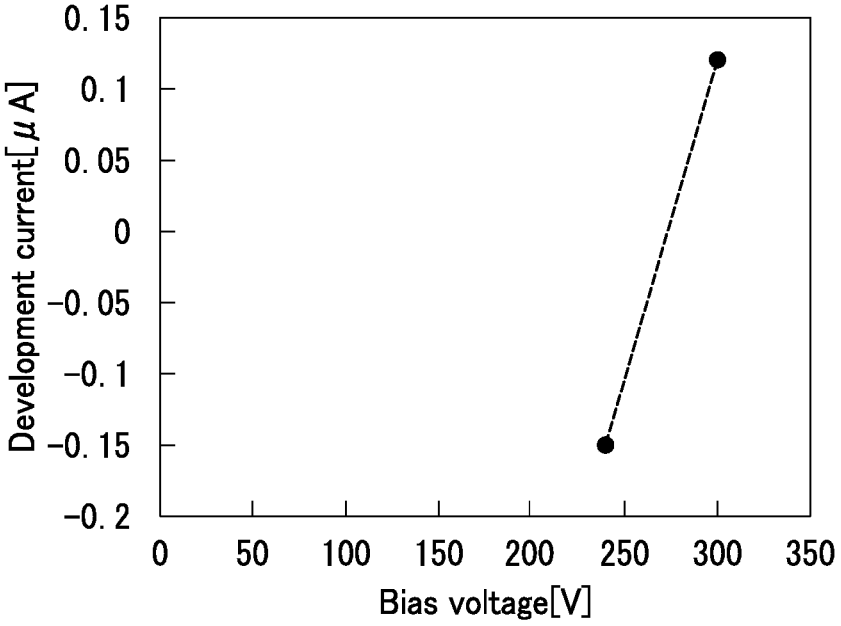
FIG. 10 is a table indicating development currents measured when a two-stage bias voltage is applied to a development roller in the image forming apparatus according to Example.
FIG. 11 is a graph illustrating a relationship between the bias voltage and the development current indicated in FIG. 10.

FIG. 10 is a table indicating development currents measured in the image forming apparatus 1 according to Example when a two-stage bias voltage was applied to the development roller 641.

FIG. 11 is a graph representation showing a relationship between the bias voltage and the development current indicated in FIG. 10. In FIG. 11, the vertical axis indicates the development current and the horizontal axis indicates the bias voltage.

In Example, the development current was −0.15 μA (reference 1) when the bias voltage was 240 V, and was 0.12 μA when the bias voltage was 300 V (reference 2).

As illustrated in FIG. 11, the surface potential was calculated as 273 V in the image forming apparatus 1 according to Example.

Figure 12:
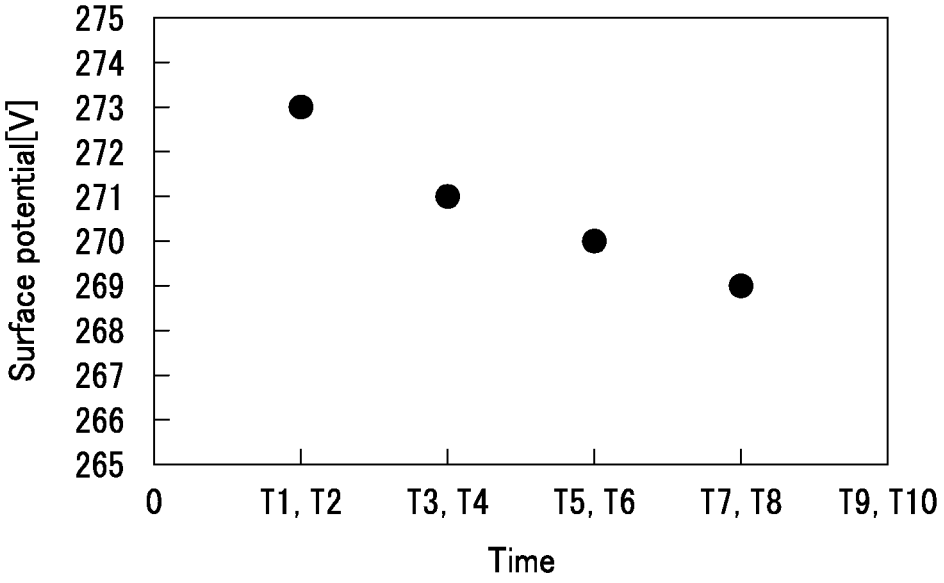
FIG. 12 is a diagram illustrating a shift in the surface potential calculated once per two periods in the image forming apparatus according to Example.

FIG. 12 illustrates a shift in the surface potential calculated once per two periods T in the image forming apparatus 1 according to Example. In FIG. 12, the vertical axis indicates the surface potential and the horizontal axis indicates time.

It is understood from FIG. 12 that the surface potential decreased as an image of a later page was formed.

The difference in the applied bias voltage applied once per two periods T was a maximum of 60 V in Example, but is not limited as such and may be a maximum of 100 V. However, it is preferable that the difference in the bias voltage applied once per two periods T be approximately 50 V.

The photosensitive drum 65 was an amorphous silicon drum in the present example, but is not limited as such and may be a positively chargeable organic photoconductor (OPC) drum. An amorphous silicon drum as the photosensitive drum 65 includes a photosensitive layer having a dielectric constant higher than that of a positively chargeable organic photosensitive drum. This can facilitate flow of the electric current and reduce the carrier resistance, thereby increasing measurement accuracy.

Also in the present example, a two-component developer was used, but the developer is not limited as such and a one-component developer may be used.

An embodiment of the present disclosure has been described so far with reference to the drawings (FIGS. 1 to 12). However, the present disclosure is not limited to the above embodiment and can be practiced in various forms without deviating from the essence thereof. The drawings are schematic illustrations that emphasize elements of configuration in order to facilitate understanding thereof, and properties such as thickness, length, and the number of elements of configuration illustrated in the drawings may differ from actual ones thereof in order to facilitate preparation of the drawings. Materials, shapes, dimensions, etc. of the elements of configuration given in the above embodiment are merely examples that do not impart any particular limitations and may be altered in various ways, so long as such alterations do not substantially deviate from effects of the present disclosure.

What is claimed is:

1. An image forming apparatus comprising:
an image bearing member with a surface on which an electrostatic latent image is formed;
a charger configured to charge the image bearing member;
a development device configured to develop the electrostatic latent image formed on the image bearing member into a toner image by supplying a toner to the image bearing member;
a development power supply configured to apply a prescribed bias voltage to the development device;
an electric current measuring section configured to measure a development current flowing in the development device; and
a calculating section configured to calculate a surface potential of the image bearing member based on the development current measured by the electric current measuring section, wherein
the development device sequentially forms a plurality of image formation toner images on respective sheets of a recording medium, the image formation toner images each being a toner image for image formation, and
the electric current measuring section measures the development current in a period during which the image formation toner images are not formed.

2. The image forming apparatus according to claim 1, wherein the development power supply applies a first bias voltage as the prescribed bias voltage to the development device in a first period, the electric current measuring section measures a first development current as the development current in the first period, the development power supply applies a second bias voltage as the prescribed bias voltage to the development device in a second period different from the first period, the electric current measuring section measures a second development current as the development current in the second period, and the calculating section calculates the surface potential based on the first development current and the second development current.

3. The image forming apparatus according to claim 1, wherein the calculating section does not calculate the surface potential in the period, during which the image formation toner images are not formed, directly after an image formation toner image having a coverage rate higher than a prescribed threshold among the image formation toner images is formed, the period being a period in which the calculation section does not calculate the surface potential.

4. The image forming apparatus according to claim 1, wherein in formation of each of the image formation toner images, the development power supply applies to the development device a bias voltage set based on the surface potential calculated by the calculating section.

* * * * *